US010925394B2

(12) United States Patent
Robinson et al.

(10) Patent No.: US 10,925,394 B2
(45) Date of Patent: Feb. 23, 2021

(54) HEIGHT ADJUSTMENT APPARATUS FOR WORKSTATIONS, WORK TABLES, SHELF SYSTEMS AND RACK SYSTEMS

(71) Applicant: INTERMETRO INDUSTRIES CORPORATION, Wilkes-Barre, PA (US)

(72) Inventors: Todd Robinson, Nazareth, PA (US); Carey Alan Roberts, Trucksville, PA (US)

(73) Assignee: INTERMETRO INDUSTRIES CORPORATION, Wilkes-Barre, PA (US)

( * ) Notice: Subject to any disclaimer, the term of this patent is extended or adjusted under 35 U.S.C. 154(b) by 0 days.

(21) Appl. No.: 16/747,029

(22) Filed: Jan. 20, 2020

(65) Prior Publication Data

US 2020/0245760 A1 Aug. 6, 2020

Related U.S. Application Data

(60) Provisional application No. 62/799,089, filed on Jan. 31, 2019.

(51) Int. Cl.
*A47B 57/54* (2006.01)
*A47B 21/02* (2006.01)
(Continued)

(52) U.S. Cl.
CPC ..... *A47B 57/545* (2013.01); *A47B 9/08* (2013.01); *A47B 21/02* (2013.01); *A47B 31/00* (2013.01);
(Continued)

(58) Field of Classification Search
CPC ..... A47B 9/14; A47B 47/00; A47B 47/0083; A47B 57/30; A47B 57/34; A47B 57/545;
(Continued)

(56) References Cited

U.S. PATENT DOCUMENTS 2,310,346 A 2/1943 Bell
3,424,111 A 1/1969 Maslow
(Continued)

FOREIGN PATENT DOCUMENTS

CA 3004620 A1 * 5/2017 ..... G16H 20/13
DE 8702638 U1 7/1987
(Continued)

OTHER PUBLICATIONS

International Search Report and Written Opinion of the ISA for PCT/US2020/015405, ISA/EP, dated Oct. 14, 2020.

*Primary Examiner* — Jose V Chen
(74) *Attorney, Agent, or Firm* — Harness, Dickey & Pierce, P.L.C.

(57) ABSTRACT

An height-adjustment apparatus for a structure (e.g., a workstation, a work table, shelf system and/or a rack system) is disclosed including a release mechanism, a pawl coupled to the release mechanism and a sleeve including a plurality of slots. The plurality of slots is configured to receive a locking portion of the pawl, the sleeve is configured to be coupled to a support element (e.g., a leg or post) of the structure and while the release mechanism is activated the locking portion is configured to disengage from one of the plurality of slots and a height of a surface of the structure is configured to be adjusted. The surface of the structure is coupled to the apparatus via an end cap adapter.

23 Claims, 15 Drawing Sheets

(51) Int. Cl.

| | |
|---|---|
| ***A47B 9/08*** | (2006.01) |
| ***A47B 33/00*** | (2006.01) |
| ***A47B 31/00*** | (2006.01) |
| ***A47B 57/34*** | (2006.01) |
| *G09F 23/02* | (2006.01) |

(52) U.S. Cl.
CPC ..... *A47B 33/00* (2013.01); *A47B 57/34* (2013.01); *A47B 2031/003* (2013.01); *G09F 23/02* (2013.01)

(58) Field of Classification Search
CPC ..... A47B 2009/065; A47B 21/02; A47B 2031/003; A47B 33/00; G09F 23/02
USPC ..... 108/147.13, 147.17, 147.14, 147.11, 108/147.12, 147.21, 192
See application file for complete search history.

(56) References Cited

U.S. PATENT DOCUMENTS

| | | | | | |
|---|---|---|---|---|---|
| 3,704,850 | A | | 12/1972 | Hendrickson et al. | |
| 3,915,102 | A | * | 10/1975 | Barron | A47B 9/14 108/146 |
| 5,415,302 | A | * | 5/1995 | Carlson | A47B 55/02 108/147.13 |
| 5,531,167 | A | * | 7/1996 | Stevens | A47B 55/02 108/106 |
| 5,884,567 | A | * | 3/1999 | Bartz, Jr. | A47B 57/04 108/106 |
| 6,017,009 | A | * | 1/2000 | Swartz | A47B 57/10 108/147.13 |
| 6,047,750 | A | | 4/2000 | Jensen | |
| 6,113,042 | A | * | 9/2000 | Welsch | A47B 57/265 108/110 |
| 6,234,331 | B1 | | 5/2001 | Brandenberg | |
| 6,260,488 | B1 | * | 7/2001 | Yang | A47B 57/545 108/107 |
| 8,074,583 | B2 | * | 12/2011 | Lee | A47B 57/54 108/147.13 |
| 8,113,678 | B2 | * | 2/2012 | Babcock | F21V 33/0012 362/125 |
| 8,627,966 | B2 | * | 1/2014 | Jarvis | A47B 57/545 211/187 |
| 9,266,547 | B2 | * | 2/2016 | Schumaker | A47B 31/00 |
| 9,493,177 | B1 | * | 11/2016 | Chen | A47B 47/0083 |
| 10,156,249 | B2 | * | 12/2018 | Edman | F16B 2/185 |
| 10,390,614 | B1 | * | 8/2019 | Olivier | A47B 57/30 |
| 2013/0146553 | A1 | * | 6/2013 | Preidt | A47F 5/0093 211/153 |
| 2017/0340105 | A1 | * | 11/2017 | Knighton | A47B 31/00 |
| 2018/0220845 | A1 | * | 8/2018 | Dahle | A47B 37/04 |

FOREIGN PATENT DOCUMENTS

| | | | | | |
|---|---|---|---|---|---|
| EP | 3620079 | A1 | * | 3/2020 | A47B 3/08 |
| JP | 200449844 | A | | 2/2004 | |
| WO | 2012164594 | A1 | | 12/2012 | |
| WO | WO-2018225712 | A1 | * | 12/2018 | A47B 63/04 |

* cited by examiner

HEIGHT ADJUSTMENT APPARATUS FOR WORKSTATIONS, WORK TABLES, SHELF SYSTEMS AND RACK SYSTEMS

CROSS-REFERENCE TO RELATED APPLICATIONS

This application claims the benefit of U.S. Provisional Application No. 62/799,089, filed on Jan. 31, 2019. The entire disclosure of the above application is incorporated herein by reference.

FIELD

The present disclosure relates to an adjustment apparatus for workstations, work tables, shelf systems and rack systems.

BACKGROUND

This section provides background information related to the present disclosure and is not necessarily prior art.

Workstations, work tables, shelf systems and rack systems are utilized in various industries, including food service, healthcare, manufacturing and retail industries, to name a few. Work tasks performed using workstations, work tables, shelf systems and rack systems can be a labor-intensive and require a worker to perform numerous manual tasks on a surface of a work table or workstation and/or utilize various shelves or racks. Accordingly, there is a need for an apparatus that enables a user to adjust a position of the surface and/or the shelf and/or the rack in order to, for example, maximize the efficiency and comfort of the individual while performing various manual tasks.

SUMMARY

This section provides a general summary of the disclosure, and this section is not a comprehensive disclosure of its full scope or all of its features.

The present disclosure provides an adjustment apparatus including a release mechanism (or position release), a pawl coupled to the release mechanism and a sleeve including a plurality of slots. In one aspect of the disclosure, the plurality of slots is configured to receive a locking portion of the pawl, the sleeve is configured to be coupled to a support element (e.g., a leg or post) of a structure (e.g., a workstation, a work table, shelf system and/or a rack system) and while the release mechanism is activated the locking portion is configured to disengage from one of the plurality of slots and a height of a surface of the structure is configured to be adjusted. The surface of the structure is coupled to the apparatus via an end cap adapter.

In another aspect of the disclosure, the apparatus also includes a spring, coupled to the pawl and configured to compress in response to the release mechanism being activated. In still another aspect of the disclosure, the apparatus further includes a sleeve housing configured to encase at least one of a portion of the sleeve, a portion of the support element, and a portion of the pawl.

In still another aspect of the disclosure, an inner surface of the sleeve is coupled to an outer surface of the support element. In yet another aspect of the disclosure, each of the plurality of slots is defined by a rounded side and a straight side and the locking portion includes a rounded side and a straight side. Each of the plurality of slots is associated with a predefined height of the surface.

In another aspect of the disclosure, an outer surface of the sleeve includes a plurality of indicators and each of the plurality of indicators corresponds to a predefined height of the surface. In another aspect of the disclosure, the apparatus includes a sleeve housing having an opening and a position of the opening is associated with the height of the surface and one of the plurality of indicators. A height adjustment range of the structure is associated with the number of slots.

In a further aspect of the disclosure, the release mechanism is one of a release button and a release handle and is activated by being depressed and/or in response to an upward force that is applied to the surface.

In still another aspect of the disclosure, the apparatus includes a stop slot that is configured to prevent the height of the surface from being adjusted while the release mechanism is not activated. The stop slot is defined by a pair of parallel sides of the sleeve.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and the drawings are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Height adjustment apparatuses for the work platforms or shelves of workstations, work tables, shelf systems and rack systems used in various industries, including foodservice, healthcare, manufacturing and retail industries, are disclosed below. In response to activating a height adjustment apparatus, a user can quickly and efficiently adjust a height of at least one work platform or shelf of a workstation, work table, shelf system and rack system, thereby improving the user's productivity and efficiency while performing various manual tasks.

Figure 1A:
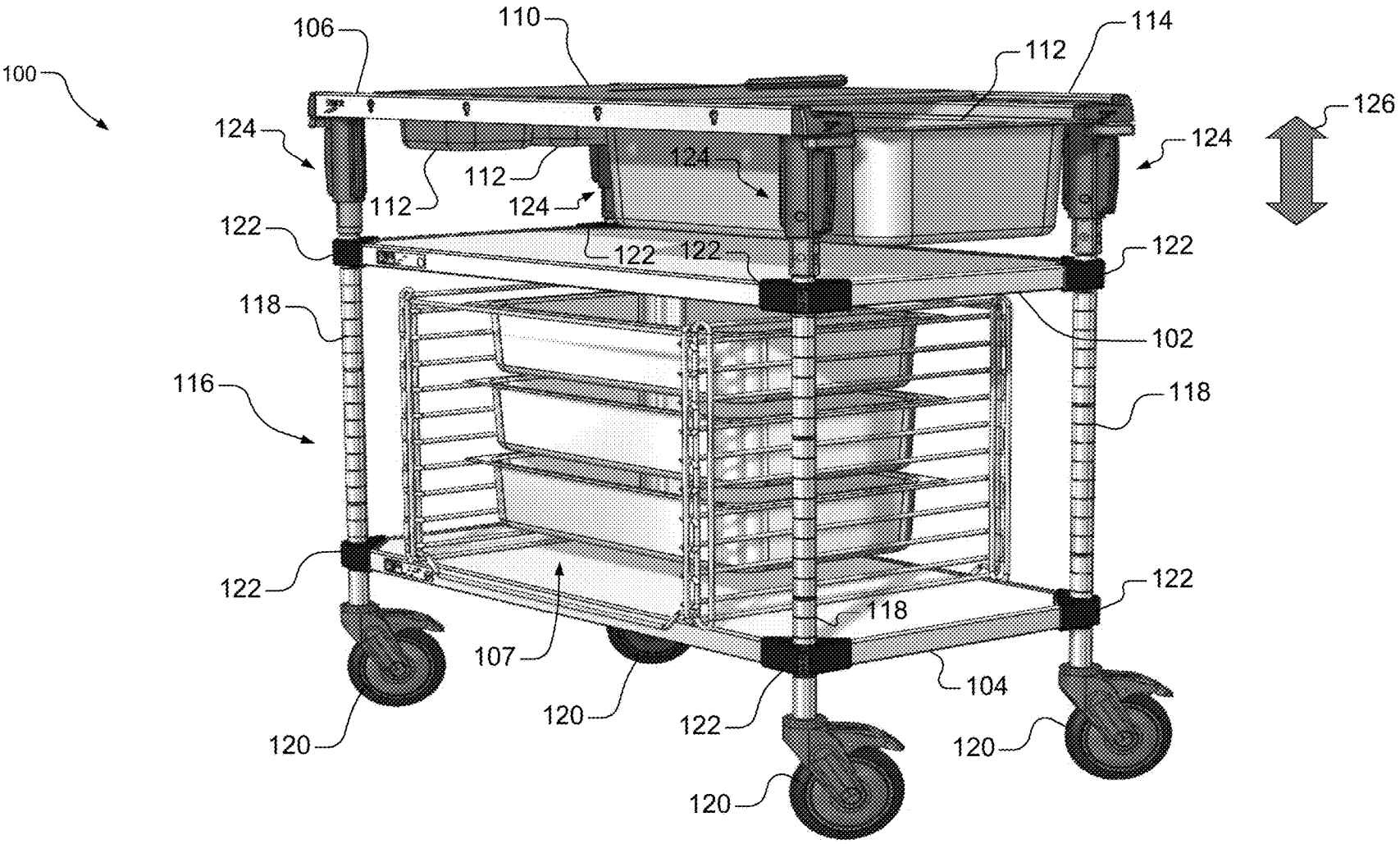
FIGS. 1A-1B are perspective views of an example workstation according to the present disclosure.
Figure 1B:
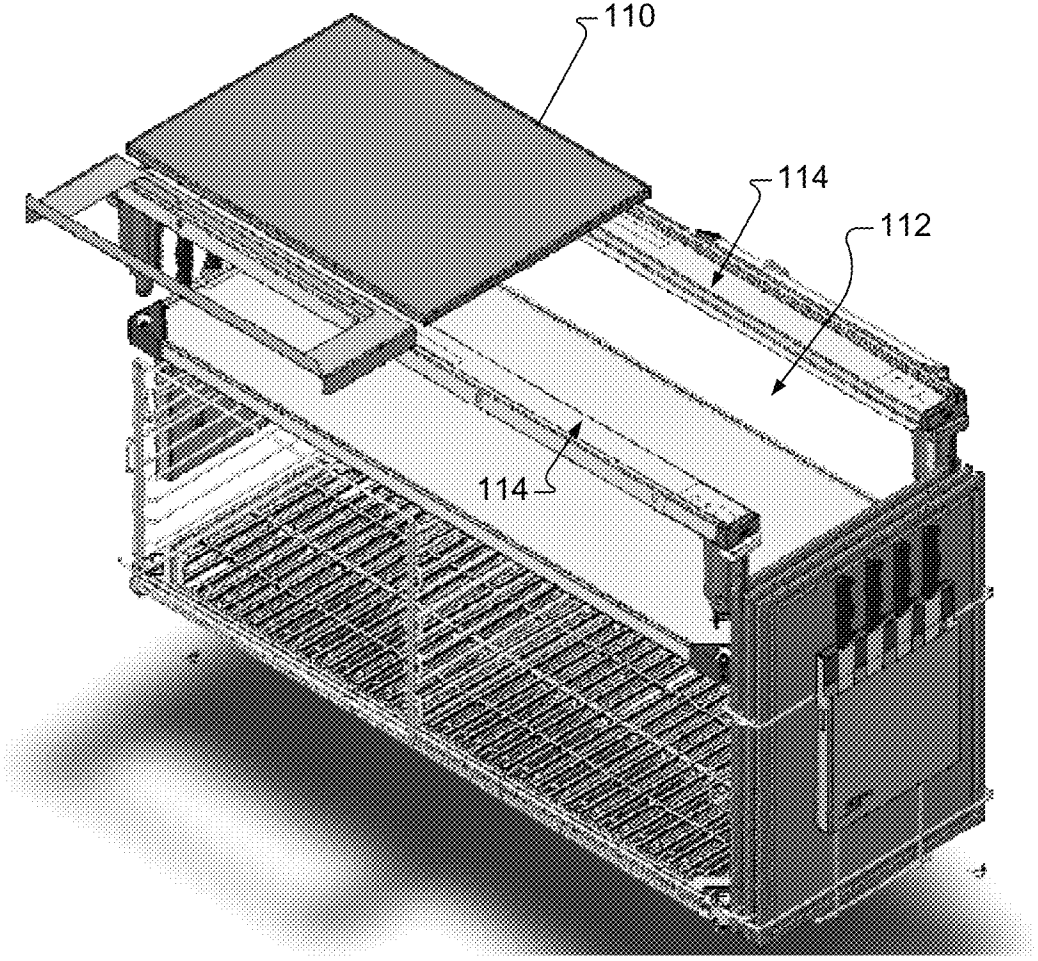

With reference to FIGS. 1A-1B, an example workstation 100 is shown. In one embodiment and as shown in FIG. 1A, the workstation 100 may be implemented by the Prep-Mate™ MultiStation workstation provided by InterMetro Industries Corporation®. In other embodiments, the workstation 100 may be implemented by any suitable apparatus utilized in the foodservice industry, manual assembly processes, quality control processes, inspection processes, and the like.

The workstation 100 may include a first work platform 102, a second work platform 104, and a third work platform 106. The first work platform 102 and the second work platform 104 are horizontally oriented platforms, and a user may place kitchen utensils, containers, storage vessels, and other apparatuses used in the food service industry on the first work platform 102 and the second work platform 104. As an example, the individual may place a container rack 107, which is configured to support at least one container (e.g., a food pan), on the second work platform 104.

The third work platform 106 may include a pair of horizontal support rails 114, a work surface 110 supported on the support rails 114, and one or more openings 112 created between the support rails 114. The work surface 110 may be a horizontal surface. Food items, utensils, ingredients, and/or other items may be placed on and manipulated on the work surface 110. As an example, the work surface 110 may be implemented by a cutting board or other similar apparatus. Furthermore, the user may adjust a position of the work surface 110 by moving the work surface along the pair of horizontal support rails 114 of the workstation 100, as illustrated in FIG. 1B. The openings 112 may be a rectangular opening that is located adjacent to the work surface 110. The opening(s) 112 may enable multi-tiered elements of the third work platform 106 to be located at or below a horizontal plane defined by the work surface 110.

The workstation 100 may also include a base 116 that is configured to support the first work platform 102, the second work platform 104, and the third work platform 106 at a desired height above the floor. The base 116 may include one or more legs 118 (e.g., vertical support members or posts) or and one or more casters 120. The legs 118 are vertical columns that are connected to the casters 120 and extend upward to support the first work platform 102, the second work platform 104, and the third work platform 106. As shown in FIG. 1A, the base 116 may include four legs 118, wherein each of the four legs is connected to a corner of the first work platform 102, the second work platform 104, and the third work platform 106. Furthermore, the legs 118 may include at least one of a sheet metal (e.g., steel, stainless steel, galvanized steel, aluminum, aluminized-steel, etc.), a plastic, and other similar materials. The legs 118 may also have various cross-sectional profiles, such as a circular cross-sectional profile, an elliptical cross-sectional profile, a rectangular cross-sectional profile, a square cross-sectional profile, or other similar cross-sectional profile.

The casters 120 are connected to a bottom surface of each of the legs 118. The casters 120 are configured to enable the user to easily move the workstation 100 from a first location to a desired location. Specifically, the user may roll the workstation 100 on the casters 120 in order to move the workstation 100 from the first location to the desired location. Furthermore, the casters 120 may include a releasable locking mechanism that is configured to prevent the workstation 100 from moving, thereby preventing undesired movements of the workstation 100 once it is at the desired location.

The first work platform 102 and the second work platform 104 may be connected to the legs 118 via respective corner supports 122 of the first work platform 102 and the second work platform 104. As an example, the corner supports 122 may include an opening that is configured to receive the legs 118, thereby enabling the base 116 to support the first work platform 102 and the second work platform 104. A shape of the opening may correspond to the cross-sectional profile of the legs 118 (i.e., if the legs 118 have a circular cross-sectional profile, the opening may also be circular). While this embodiment illustrates the corner supports 122 as part of the first work platform 102 and the second work platform 104, in other embodiments, the corner supports 122 may be included as part of the legs 118.

The third work platform 106 may be connected to the legs 118 via a respective adjustment apparatus 124 (collectively referred to as adjustment apparatuses 124). Using at least one of the adjustment apparatuses 124, the user may adjust a height of the third work platform 106, as indicated by arrow 126. Furthermore, the adjustment apparatuses 124 may include an opening that is configured to receive the legs 118, thereby enabling the base 116 to support the third work platform 106. The adjustment apparatus 124 is described below in further detail with reference to FIGS. 4A-4B.

While FIGS. 1A-1B illustrate the first work platform 102 and the second work platform 104 connected to the legs 118 via respective corner supports 122, in other embodiments, the first work platform 102 and/or the second work platform 104 may be connected to the legs 118 using adjustment apparatuses 124. Accordingly, the user may adjust the height of the first work platform 102 and/or the second work platform 104 using the adjustment apparatuses 124.

Figure 2A:
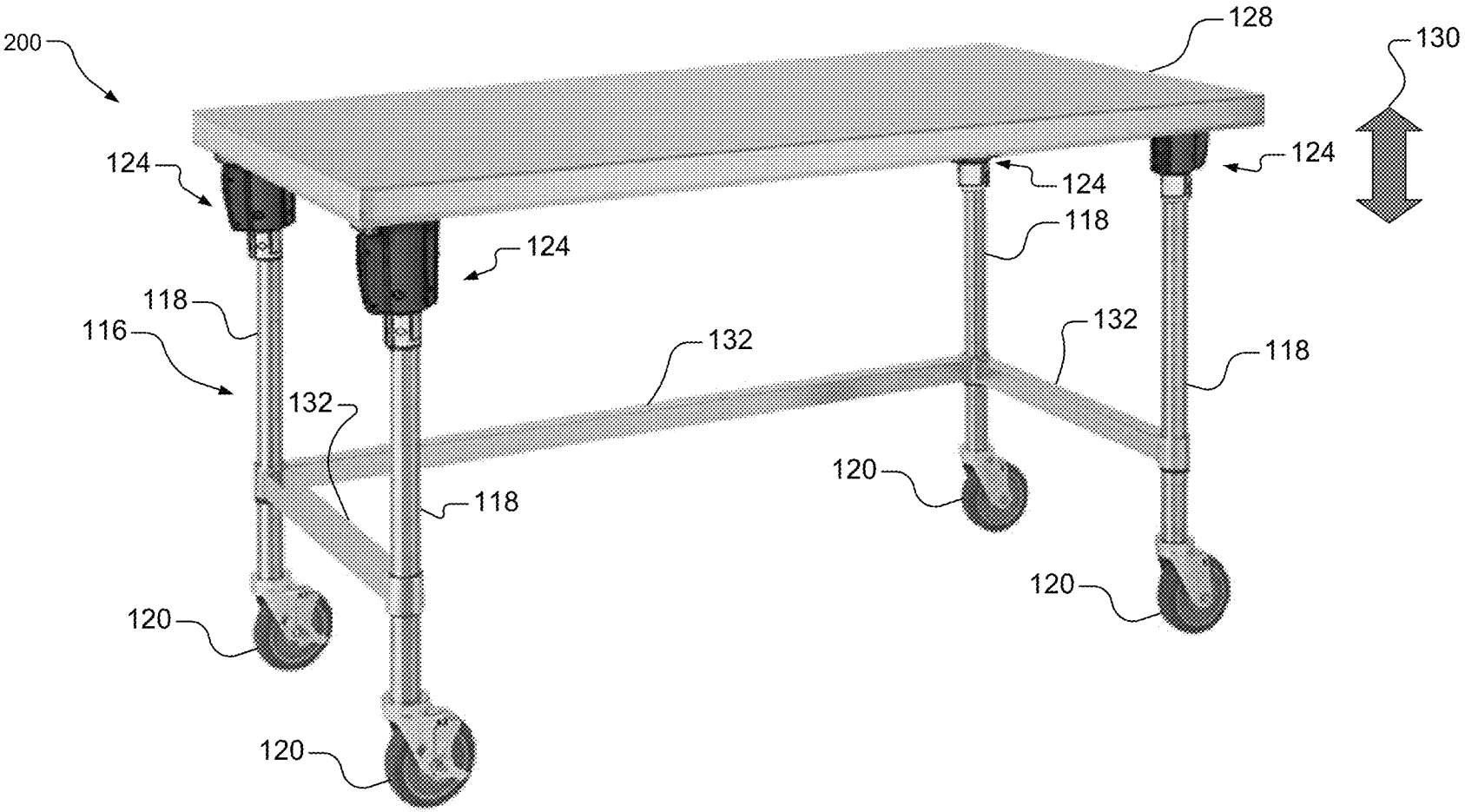
FIGS. 2A-2G are perspective views of example work tables according to the present disclosure.
Figure 2B:
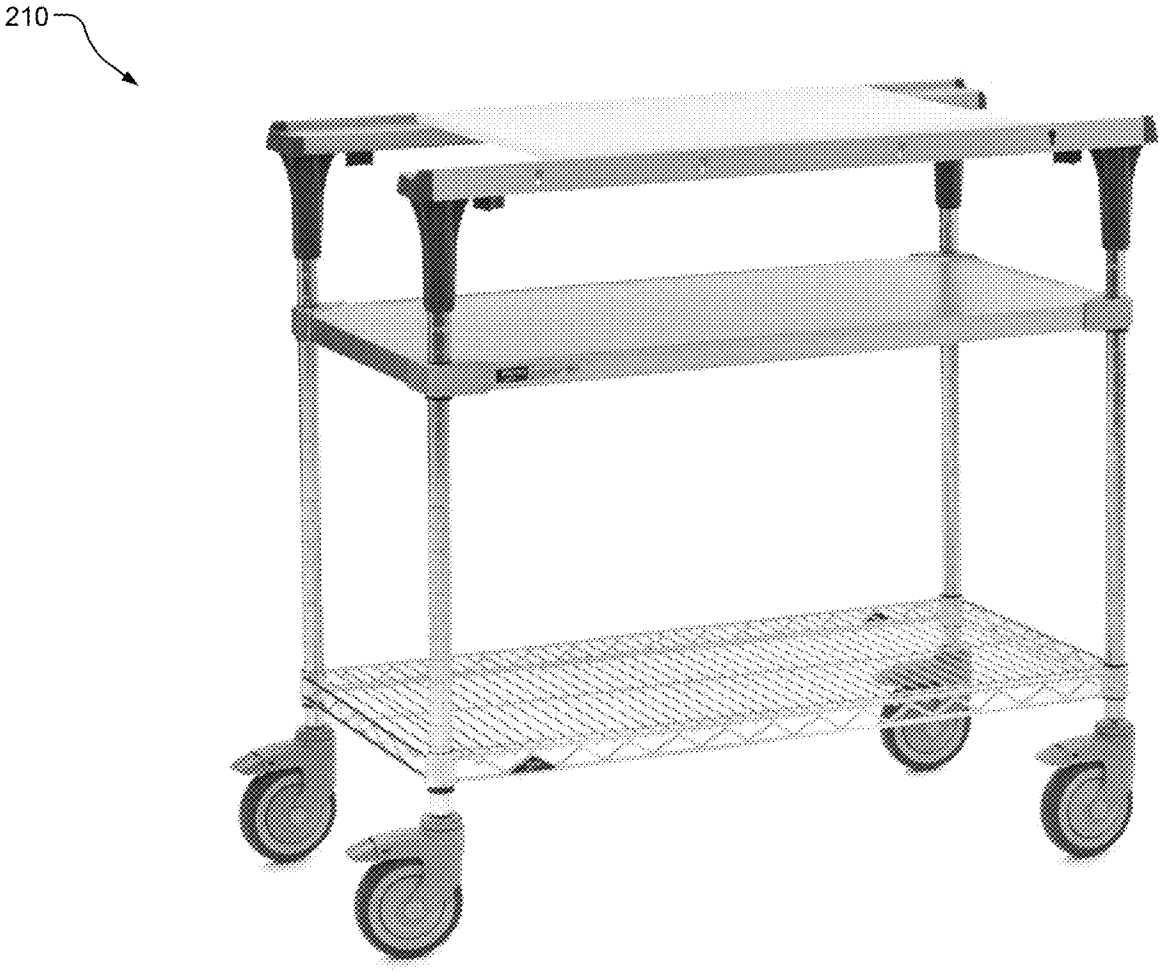
Figure 2D:
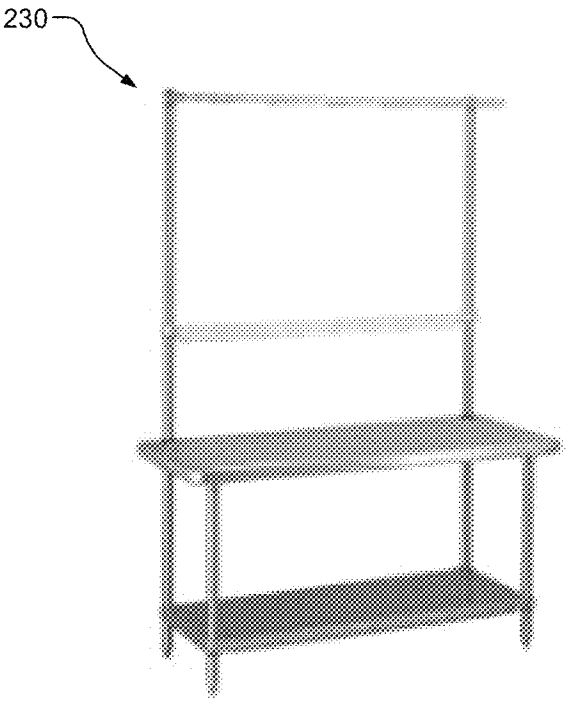
Figure 2C:
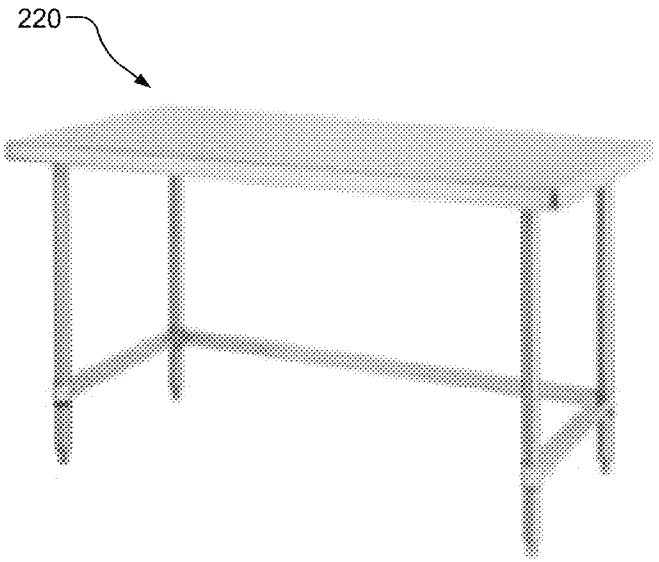
Figure 2E:
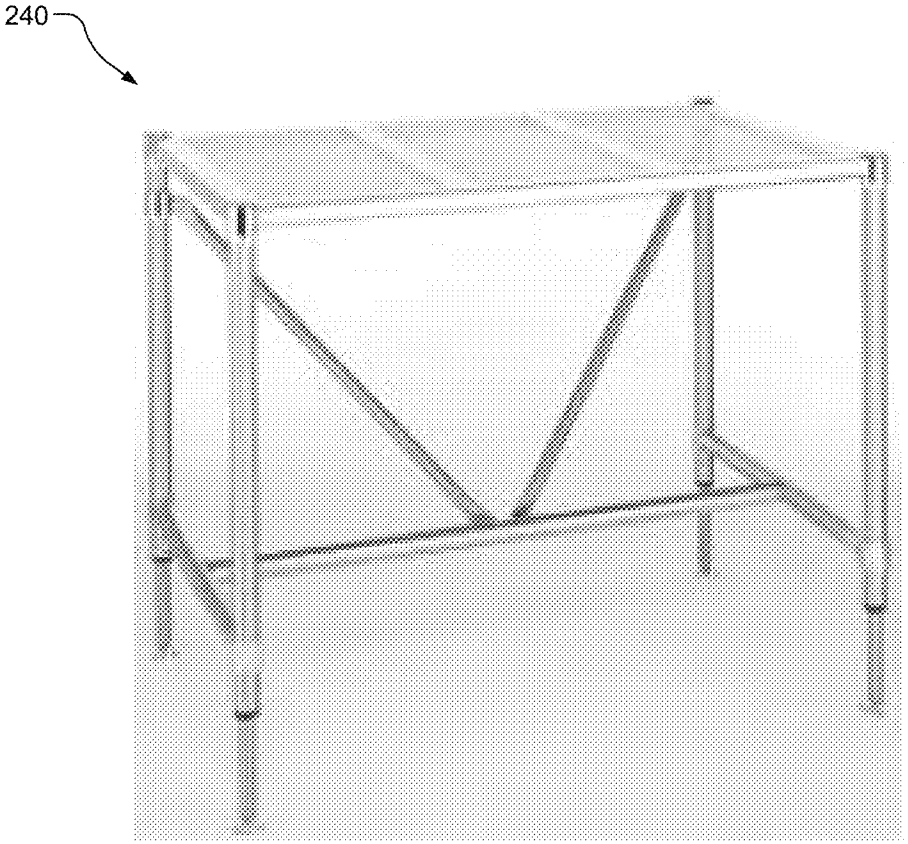
Figure 2G:
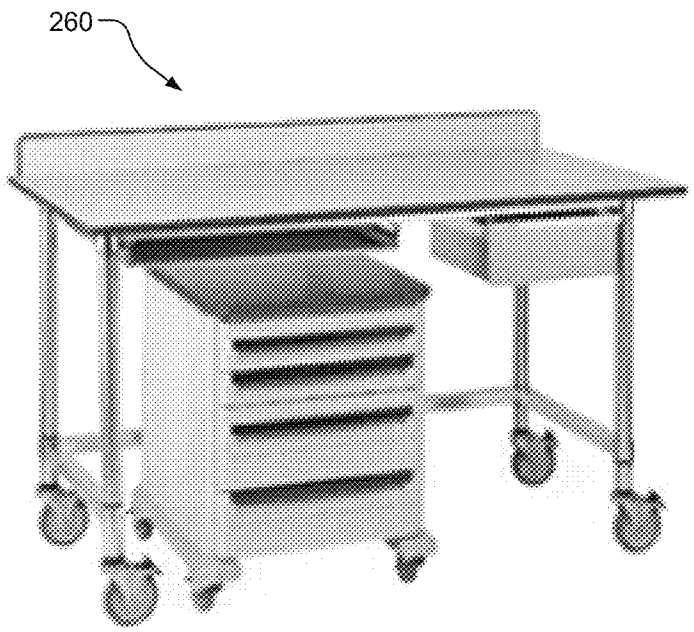
Figure 2F:
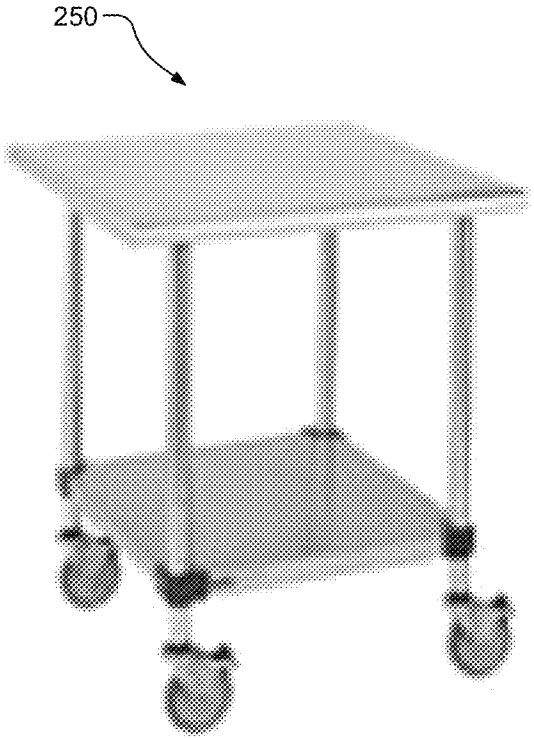

With reference to FIG. 2A, an example work table 200 is shown. The work table 200 may be utilized in the foodservice industry, manual assembly processes, quality control processes, inspection processes, and the like. The work table 200 is similar to the workstation 100 described above with reference to FIGS. 1A-1B, but in this embodiment, the work table 200 includes a work platform 128, which is connected to the legs 118 via the adjustment apparatuses 124. Similar to the workstation 100, the user may adjust the height of the work platform 128 using at least one of the adjustment apparatuses 124, as indicated by arrow 130. Additionally, the base 116 includes braces 132 that are connected to and extend between at least one of the legs 118. The braces 132 are configured to maintain a rigidity of the base 116.

With reference to FIGS. 2B-2G, additional example work tables 210, 220, 230, 240, 250, 260 are shown. Each of the work tables 210, 220, 230, 240, 250, 260 may include at least one adjustment apparatus 124 (not shown), thereby enabling the user of one of the work tables 210, 220, 230, 240, 250, 260 to adjust a height of at least one surface of the respective work table.

Figure 3:
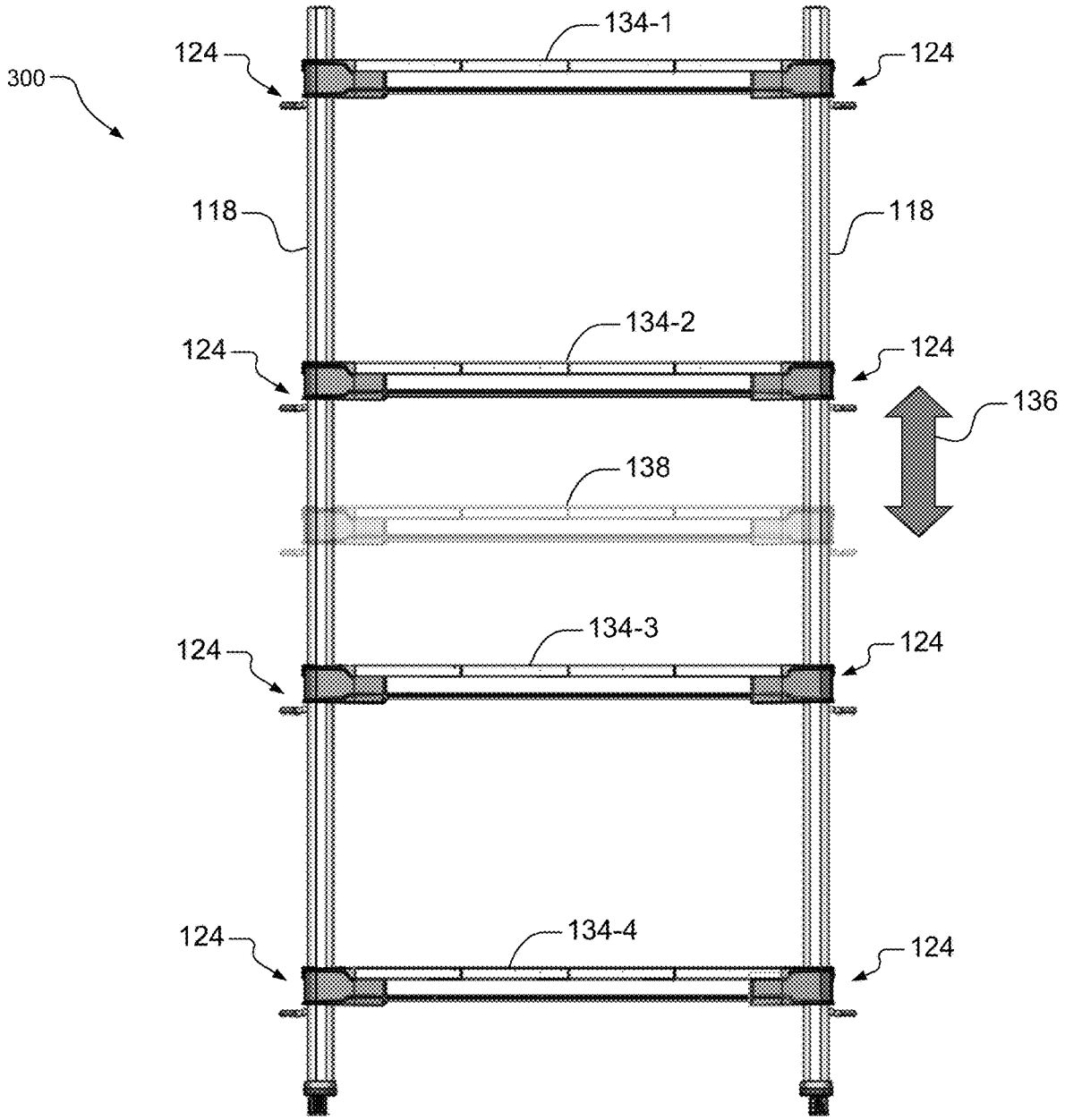
FIG. 3 is a perspective view of an example shelf system according to the present disclosure.

With reference to FIG. 3, an example shelf system 300 is shown. In one embodiment and as shown in FIG. 3, the shelf system 300 may be utilized to store and organize containers, equipment, tools, and removable objects associated with the foodservice industry, manual assembly processes, quality control processes, inspection processes, and the like. The shelf system 300 may include the legs 118, the adjustment apparatuses 124, and shelf 134-1, 134-2, 134-3, 134-4 (collectively referred to as shelves 134). The shelves 134 may be implemented by at least one of a wire shelving unit, plastic shelving unit, solid shelving unit, basket shelving unit, and other similar shelving units. In other embodiments, the shelf system 300 may also include a plurality of casters (not shown) connected to each of the legs 118, thereby enabling the user to easily move the shelf system 300 from a first location to a desired location.

Similar to the workstation 100 and the work tables 200, 210, 220, 230, 240, 250, 260 described above, the user may adjust a vertical position of at least one of the work platforms 106, 128 or shelves 134 using at least one adjustment apparatus 124 associated with the respective work platforms or shelves 134. As a specific example and as indicated by arrow 136, the user may move shelf 134-2 from its current position to a second position, as indicated by grayed-out shelf 138.

Figure 4A:
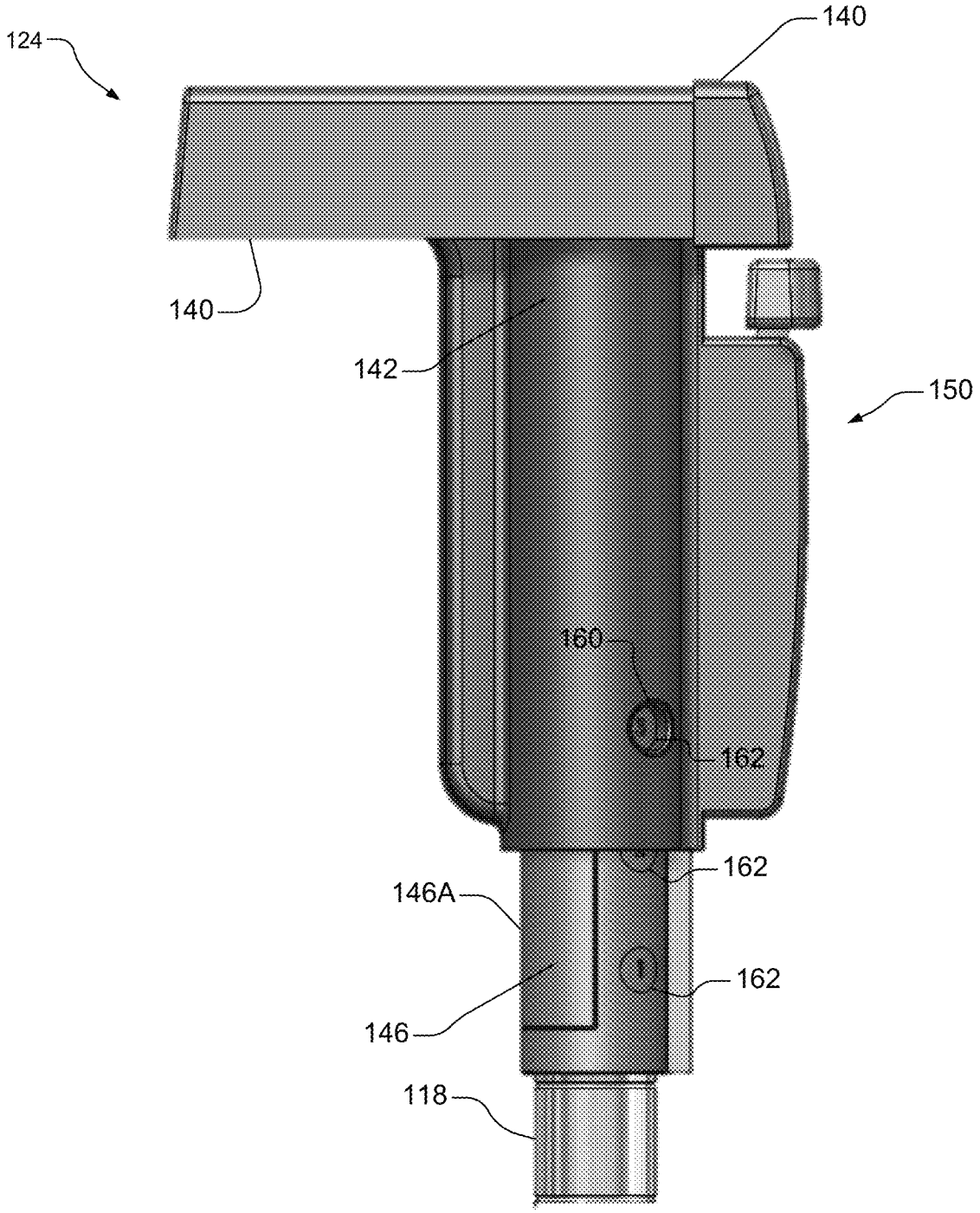
FIG. 4A illustrates a front view of an adjustment apparatus according to the present disclosure.
Figure 4B:
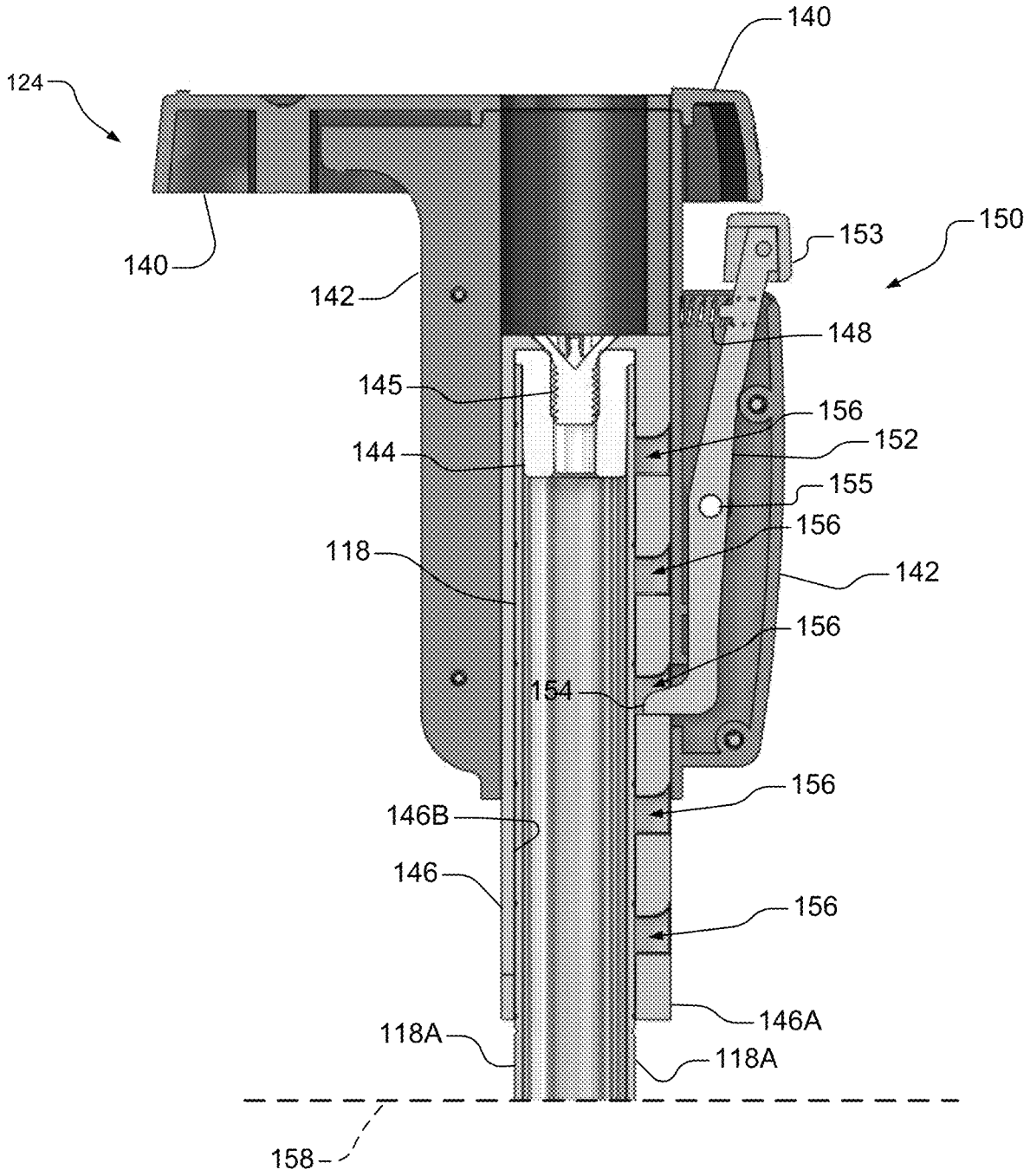
FIG. 4B illustrates a front cross-sectional view of the adjustment apparatus according to the present disclosure.

Referring now to FIGS. 4A-4B, the adjustment apparatus 124 of the present disclosure is illustrated in detail. With reference to FIG. 4A, a front view of the adjustment apparatus 124 is shown. In one embodiment, the adjustment apparatus 124 includes at least one end cap adapter 140, a leg sleeve housing 142 incorporating a release mechanism (or position release) 150, and a leg sleeve 146.

With reference to FIG. 4B, a detailed cross-sectional view of the adjustment apparatus 124 is shown. In one embodiment, the adjustment apparatus 124 further includes a leg insert 144 and an insert screw 145. Additionally, the release mechanism 150 is shown to include a lever or pawl 152 that is pivotally attached to the leg sleeve housing 142 by a pin 155. The pawl 152 includes a release button 153 at a first end and a locking portion or tab 154 at a second, opposite end. The pawl 152 is biased by a biasing member or spring 148.

In one embodiment and as shown in FIGS. 1A and 4A, a surface (e.g., the first work platform 102, the second work platform 104, the third work platform 106, the work surface 128, the shelves 134, etc.) is coupled to a first and second end cap adapter 140. As an example, the first and second end cap adapter 140 may snap or otherwise connect to the surface using any suitable attachment/fastening methods and/or devices. Additionally, the leg sleeve housing 142 is disposed over at least one of the leg inserts 144, a portion of the leg sleeve 146, and a portion of the leg 118.

As shown in FIG. 4B, the leg sleeve 146 is fixed over at least a portion of the leg 118, and an inner surface 146B of the leg sleeve 146 is coupled to an outer surface 118A of the leg 118. Accordingly, a cross-sectional profile of the leg sleeve 146 may correspond to the cross-sectional profile of the leg 118 (e.g., both the leg sleeve 146 and the leg 118 have circular cross-sectional profiles). Furthermore, the leg sleeve 146 includes a plurality of vertically-spaced horizontal slots 156. Each of the plurality of slots 156 may have a size, depth, and geometry to accommodate the locking tab 154, thereby enabling the locking tab 154 to disengage from and engage with each of the individual slots of the plurality of slots 156. As an example and as shown in FIG. 4B, the locking tab 154 may have and arcuate surface (e.g., a rounded side) and a planar surface (e.g., a straight or flat side), and as such, the slots 156 may be defined by an arcuate surface (e.g., a rounded side) and a planar surface (e.g., a straight or flat side). The geometry of the locking tab 154 and the slots 156 are described below in further detail with reference to FIG. 5A.

Figure 5A:
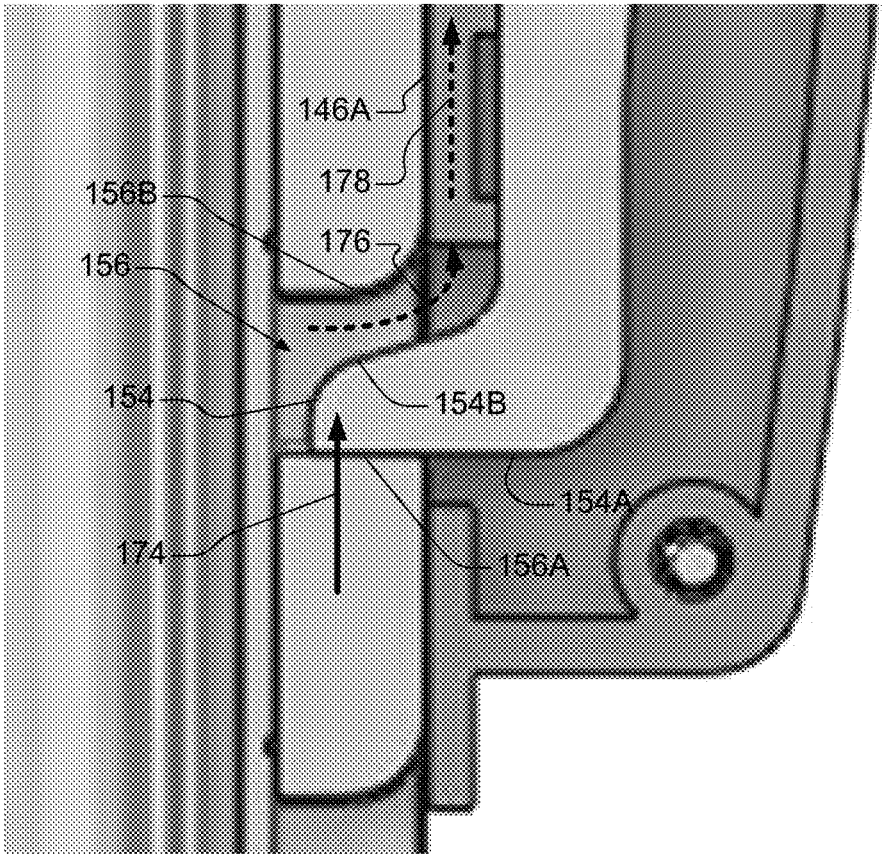
FIG. 5A illustrates a front cross-sectional detail view showing a pawl and a slot of the adjustment apparatus according to the present disclosure.

Referring now to FIG. 5A, a front cross-sectional detail view of the locking tab 154 and one of the plurality of slots 156 is shown. In this embodiment, the locking tab 154 includes a planar surface (e.g., a straight or flat side) 154A and an arcuate surface (e.g., a rounded side) 154B. Furthermore, the slot 156 is defined by a planar surface (e.g., a straight or flat side) 156A and an arcuate surface (e.g., a rounded side) 156B. Initially and while the user is not applying an upward or downward force to the surface, the straight side 154A contacts the straight side 156A defining the slot 156. While applying an upward force on the surface, as indicated by dashed arrow 174, the rounded side 154B of the locking tab 154 is configured to engage against the rounded side 156B defining the slot 156. The locking tab 154 engaging the slot side 156B produces a reaction force causing the pawl 152 to pivot about the pin 155 and the locking tab 154 to move out of the slot 156 as indicated by dashed arrow 176. Once the locking tab 154 pivots outwardly and disengages from the slot 156, the locking tab 154, biased by the spring 148, is configured to ride along the outer surface 146A of the leg sleeve 146, as indicated by dashed arrow 178. The locking tab 154 is configured to slide along the outer surface 146A of the leg sleeve 146 until it reaches the next slot 156 of the plurality of slots, at which time the bias of the spring 148 against the pawl 152 causes the locking tab 154 to "snap" into engagement with the next slot 156. Such engagement may be indicated by an audible feedback (e.g., a clicking noise) and/or a tactile feedback to the user.

In other embodiments, the straight side 154A and rounded side 154B of the locking tab 154 may have other geometries. As an example, the straight side 154A may have a nonlinear geometry. As another example, the rounded side 154B may be implemented by different sides having various slopes. Likewise, the straight side 156A and the rounded side 156B defining the slot 156 may have alternative geometries that accommodate the geometry of the locking tab 154.

With reference again to FIGS. 4A-4B, the user may lower the height of the surface by applying the downward force (i.e., pushing down) on the surface while activating the release mechanism 150. Operation of the release mechanism 150 is initiated by engaging (e.g., depressing) the release button 153. Engaging the release button 153 causes the spring 148 (e.g., a compression spring) to compress, which subsequently causes the locking tab 154 to disengage from one of the slots 156. Subsequently and while the release mechanism 150 is depressed, the user may apply the downward force on the surface in order to lower the height of the surface. While the user continues to apply the downward force, the locking tab 154 slides downward along the outer surface 146A, and the leg sleeve 146 slides downward along the leg 118. Once the user has set the height of the surface to a desired height, the user may release the release mechanism 150, which causes the locking tab 154 to engage with one of the plurality of slots 156 and subsequently prevent the user from lowering the height of the surface. The engagement with one of the slots 156 may be indicated by an audible feedback (e.g., a clicking noise) and/or a tactile feedback to the user.

Furthermore, the user may raise the height of the surface (e.g., the third work platform 106 illustrated in FIG. 1A) by applying an upward force (i.e., lifting) on the surface. The geometry of the plurality of slots 156 and the locking tab 154 enables the pawl 152 to ride along a surface of the respective slot 156 and the inner surface 1468 of the leg sleeve 146 while applying the upward force, as described above. As an example, when the user applies the upward force, the straight side of the slot 156 contacts the straight side of the locking tab 154, thereby causing the locking tab 154 to pivot outwardly and disengage from the respective slot 156. Furthermore, while the user continues to apply the upward force, the locking tab 154 slides upward along the outer surface 146A until the locking tab 154 reaches the next slot 156, and the leg sleeve 146 slides upward along the leg 118. Once the locking tab 154 reaches the next slot 156, the locking tab 154 is configured to engage with the next slot 156, thereby causing the height of the surface to increase. As described above, the engagement with the next slot 156 may be indicated by any audible feedback (e.g., a clicking noise) and/or tactile feedback. If the user discontinues applying the upward force once the locking tab 154 reaches the next slot 156, the surface will remain at that position until an upward force is applied and/or the user initiates operation of the release mechanism 150.

Additionally, the user may raise the height of the surface by applying the upward force on the surface while activating the release mechanism 150. As an example, once the release mechanism 150 is depressed, the user may apply the upward force to the surface (e.g., the third work platform 106 illustrated in FIG. 1A) in order to raise the height of the surface. Once the user has set the height of the surface to a desired height, the user may release the release mechanism 150, which causes the locking tab 154 to engage with one of the plurality of slots 156.

Each of the plurality of slots 156 may correspond to a predefined height, and a number of slots may indicate a height adjustment range of the corresponding surface. As an example and as shown in FIG. 4B, the leg sleeve 146 may include five (5) slots 156, and each of the slots 156 may be separated by a fixed length, such as one (1) inch. Therefore, the height adjustment range of the corresponding surface may be five inches with respect to a nominal position, which is indicated by dashed line 158. While this embodiment illustrates five slots 156 that are each separated by one inch, in other embodiments, any number of slots 156 may be implemented and may be separated by any suitable length corresponding to a desired height adjustment range.

When the height of the surface corresponds to the nominal position, the locking tab 154 may refrain from engaging with any of the slots 156. In order to provide structural support to the work surface while the locking tab 154 is disengaged from the slots 156, the leg insert 144 and the insert screw 145 may be configured to couple the leg 118 to the surface (e.g., the third work platform 106) and/or end cap adapter 140 at the nominal position.

With reference again to FIG. 4A, the leg sleeve housing 142 may include an opening 160 that enables the user to view indicators 162 located on an outer surface 146A of the leg sleeve 146. Each of the indicators 162 may be associated with one of the plurality of slots 156 and with a predefined height. Accordingly, the user may be able to accurately select a desired height of the surface by referencing the indicators 162 while adjusting the height of the surface. Additionally, the indicators 162 may include text and/or graphics associated with the predefined height.

Figure 4C:
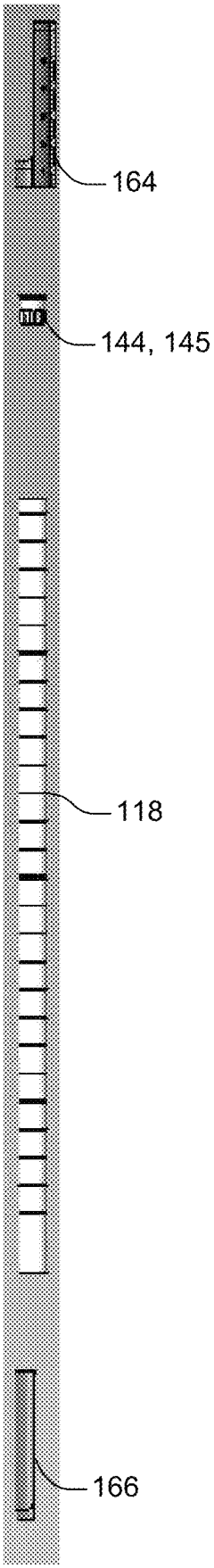
FIGS. 4C-4D illustrate exploded views of the adjustment apparatus according to the present disclosure.
Figure 4D:
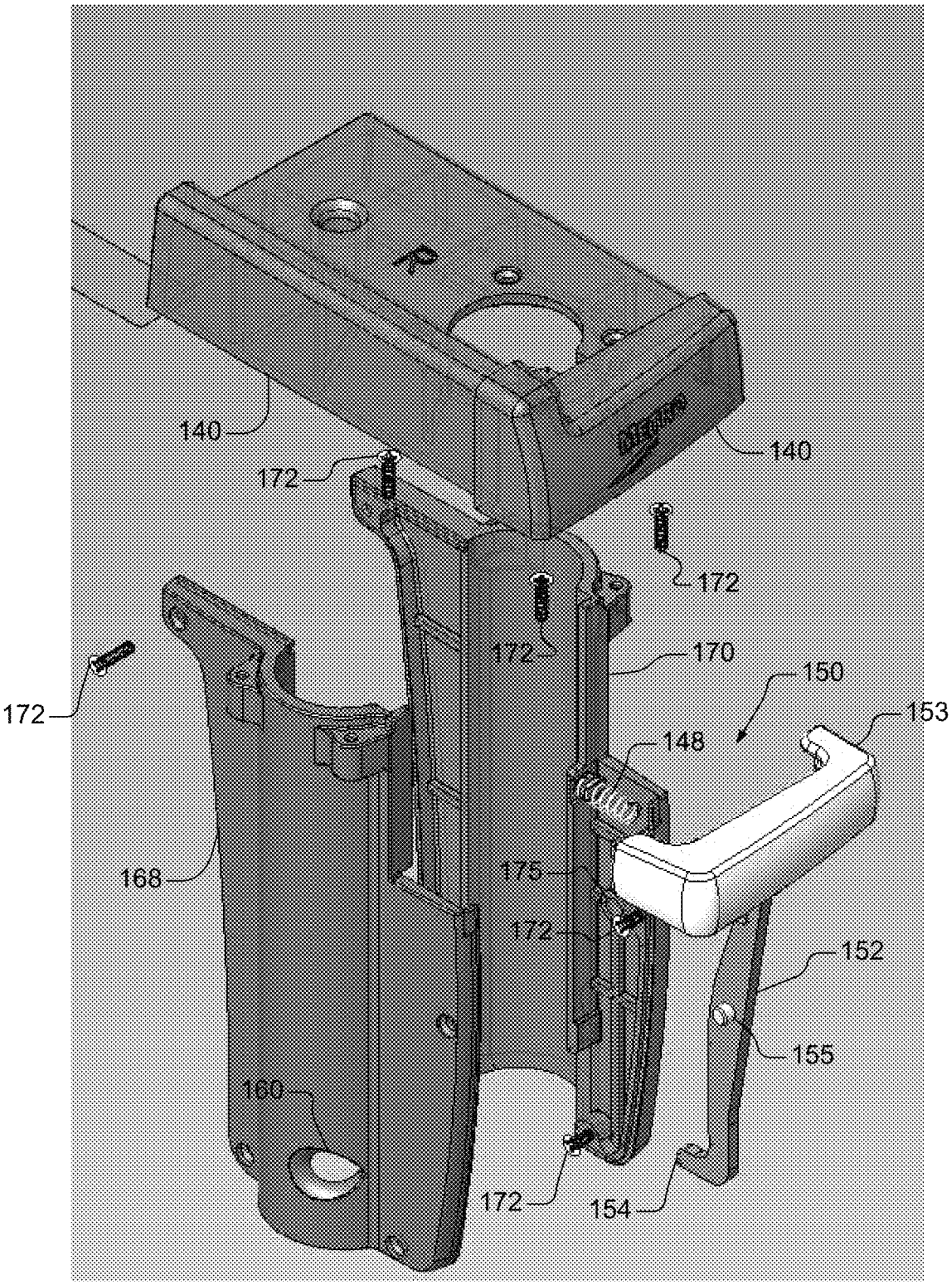

With reference to FIGS. 4C-4D, exploded views of the adjustment apparatus 124 are shown. As illustrated in FIG. 4C, the leg sleeve 146 may include a first portion 164 and a second portion 166 that are fixed over at least a portion of the leg 118. The insert screw 145 and the leg insert 144 are configured to secure and fasten the leg 118, the first portion 164 of the leg sleeve 146, and the second portion 166 of the leg sleeve 146. As an example, the leg insert 144 may be positioned within a cavity defined by the leg 118, and the insert screw 145 may be threadably engaged with the leg insert 144.

As illustrated in FIG. 4D, the leg sleeve housing 142 may be implemented by a first housing portion 168 and a second housing portion 170. The first housing portion 168 and the second housing portion 170 are disposed over the leg 118 and the leg sleeve 146. The first housing portion 168 and the second housing portion 170 may be coupled via a plurality of screws 172. Furthermore, the second housing portion 170 includes an opening 175 that is configured to receive the pin 155 and includes the spring 148. Additionally, the first portion 164 of the leg sleeve 146 may include the plurality of slots 156 and a stop slot, as described below in further detail with reference to FIG. 5B.

Figure 5B:
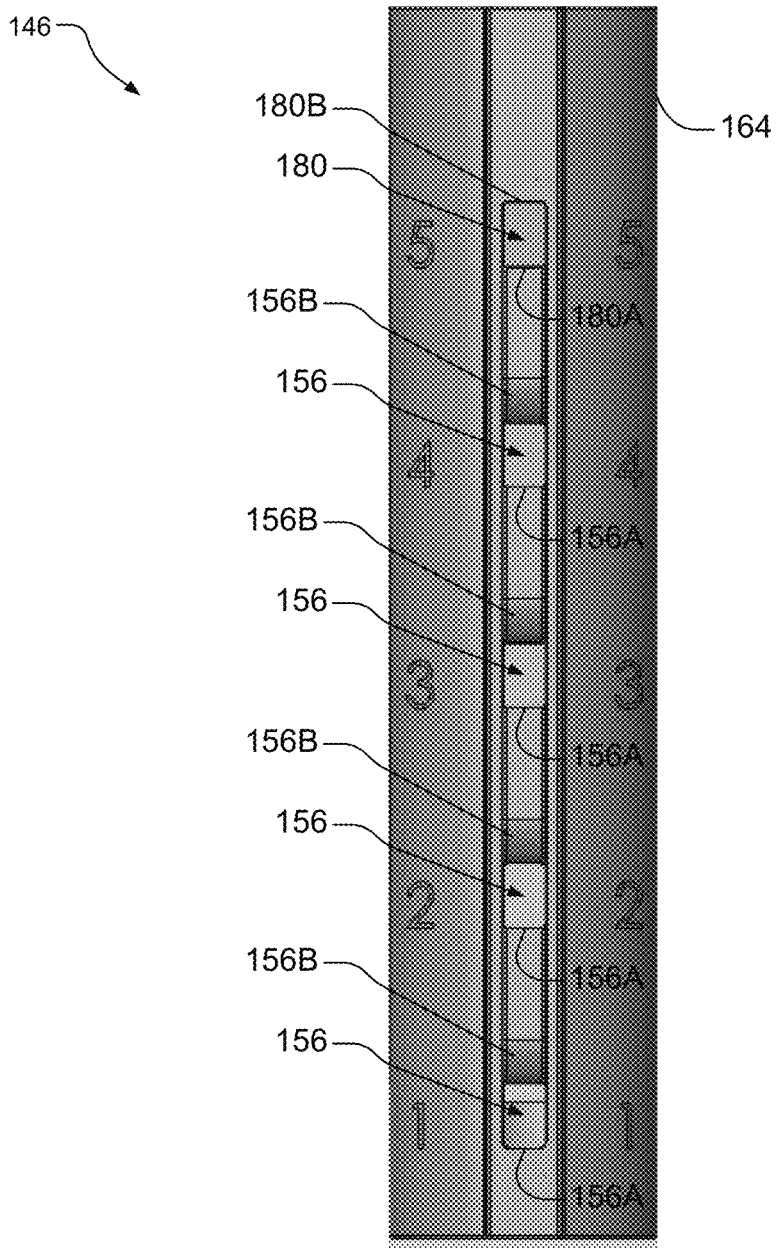
FIG. 5B illustrates a front view of a plurality of slots and a stop slot of the adjustment apparatus according to the present disclosure.

Referring now to FIG. 5B, a front view of the first portion 164 of the leg sleeve 146 incorporating the plurality of slots 156 and a stop slot 180 is shown. As described above, each individual slot of the plurality of slots 156 may be defined by a respective straight side 156A and rounded side 156B. Moreover, the stop slot 180 may be defined by a pair of parallel, straight sides 180A, 180B. The stop slot 180 may be configured to prevent the user from inadvertently or purposefully removing the surface from the workstation 100, work table 200, or shelf system 300 while adjusting the height of the respective surface. Furthermore, the stop slot 180 may be configured to provide a preferred range of height adjustment for a surface or provide an upper vertical adjustment limit for a surface. While the stop slot 180 is illustrated above the plurality of slots 156, in other embodiments, an additional stop slot 180 may be included below the plurality of slots 156 in order to provide a lower adjustment limit for the surface.

Figure 5C:
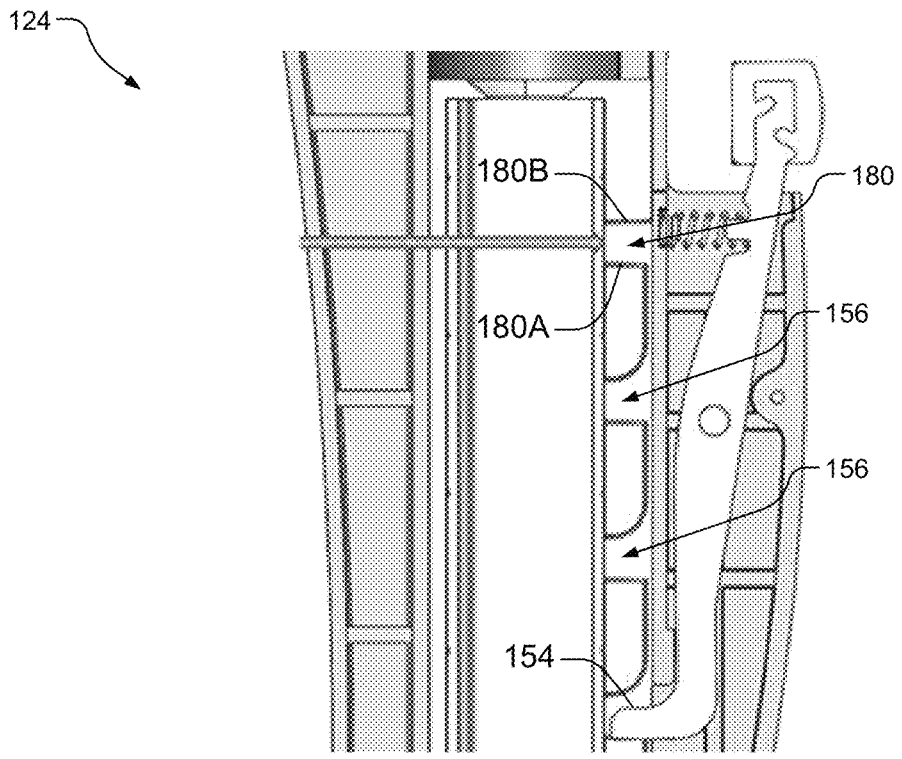
FIG. 5C illustrates a front cross-sectional view showing a stop slot of the adjustment apparatus according to the present disclosure.

Additionally and as illustrated in FIG. 5C, the stop slot 180 may have a size, depth, and geometry to accommodate the locking tab 154, thereby enabling the locking tab 154 to disengage from and engage with the stop slot 180. Furthermore, the geometry of the stop slot 180 is configured to prevent the user from adjusting a height of the surface by merely applying the upward or downward force on the respective surface while the locking tab 154 is engaged with the stop slot 180. More specifically, the straight sides 180A, 180B defining the stop slot 180 are configured to substantially oppose downward and upward forces applied to the surface while the locking tab 154 is engaged with the stop slot 180, thereby locking the position of the surface. In order to adjust the height of the surface when the locking tab 154 is engaged with the stop slot 180, the user may activate the release mechanism 150 and subsequently apply the upward or downward force to the surface, as described above.

In other embodiments, the adjustment apparatus 124 may include a stop pin (not shown) or other similar apparatus that is configured to prevent the user from inadvertently or purposefully removing the surface from the workstation 100, work table 200, or shelf system 300 while adjusting the height of the respective surface. As an example, the stop pin may be disposed within the leg sleeve 146 and/or the leg 118 in order to provide a preferred range of height adjustment for a surface or provide an upper and lower vertical adjustment limit for the surface.

While the above embodiments illustrate the adjustment apparatus 124 including the release mechanism 150 and being configured to adjust the height of the surface while engaging the release mechanism, in other embodiments, the workstation 100, work table 200, or shelf system 300 may include one or more actuators (not shown) that are configured to simultaneously engage at least one of the adjustment apparatuses 124. As an example, the workstation 100 may include an actuator (e.g., a bar) that is physically coupled to each of the release buttons 153 of the respective adjustment apparatuses 124 (i.e., the actuator is physically coupled to four (4) of the release buttons 153). Accordingly, activation of each of the release mechanisms 150 is initiated by actuating the actuator. As another example, the workstation 100 may include two actuators (2) that are each physically coupled to two (2) of the release buttons 153. Accordingly, activation of each of the release mechanisms 150 is initiated by actuating both of the actuators.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

What is claimed is:

1. A height adjustment apparatus for a workstation, work table, shelf system, rack system and the like, of the type comprising a work platform or shelf supported by one or more vertical support members each extending along a vertical axis and having an upper end portion, the height adjustment apparatus comprising:

a sleeve member attached to the upper end portion of one of the one or more vertical support members, wherein the sleeve member extends along the vertical axis and has a lower end, an upper end, an inner surface and an outer surface, the sleeve member comprising a plurality of generally horizontally-oriented and vertically-spaced slots in the outer surface of the sleeve member, each of the plurality of slots being defined by an upper side comprising an arcuate surface and a lower side comprising a planar surface, wherein the upper side and the lower side are spaced apart by a first distance;

a housing comprising an inner surface and being disposed over at least a portion of the outer surface of the sleeve member, the inner surface of the housing being moveable along the outer surface of the sleeve member along the vertical axis;

an end cap adapter located at an upper end of the housing and coupled to the work platform or shelf, wherein the end cap adapter and the work platform or shelf are moveable with the housing;

wherein the housing comprises a position release, the position release comprising a pawl pivotally coupled to the housing at a pivot location and a biasing member biasing the pawl in a first pivot direction about the pivot location, wherein the pawl comprises a user actuation interface on a first side of the pivot location and a locking tab on a second side of the pivot location, and wherein the locking tab comprises an upper side comprising an arcuate surface and a lower side comprising a planar surface, wherein the upper side and the lower side are spaced apart by a second distance that is less than the first distance;

wherein the position release has a deactivated state and an activated state;

wherein when the user actuation interface is disengaged and the locking tab of the pawl is operable to engage any of the plurality of slots in the sleeve member the position release is in the deactivated state and when the user actuation interface is engaged to overcome the bias of the biasing member and to pivot the pawl in a second pivot direction such that the locking tab is inoperable to engage any of the plurality of slots in the sleeve member the position release is in the activated state; and wherein, when the position release is in the deactivated state, the housing is movable along the vertical axis only in a first direction and, when the position release is in the activated state, the housing is movable along the vertical axis in both the first direction and in a second direction opposite the first direction.

2. The height adjustment apparatus of claim 1, further comprising an insert attached to the upper end portion of the one vertical support member;

wherein the sleeve member is disposed over the insert such that at least a portion of the insert is located intermediate the sleeve member and the one vertical support member; and wherein the sleeve member is attached to the insert.

3. The height adjustment apparatus of claim 1, wherein the housing comprises an opening in a wall of the housing;

wherein the sleeve member further comprises indicia associated with the plurality of slots in the sleeve member, wherein the indicia is representative of a predetermined height adjustment for the work platform or shelf; and wherein the indicia is visible through the opening in the wall of the housing.

4. The height adjustment apparatus of claim 3, wherein the indicia comprises text or graphics associated with each of the plurality of slots in the sleeve member;

wherein the text or graphics is representative of a predetermined height position of the work platform or shelf.

5. The height adjustment apparatus of claim 1, wherein the sleeve member comprises a stop slot defined by an upper side comprising a planar surface and a lower side comprising a planar surface;

wherein the stop slot is located vertically above an uppermost slot of the plurality of slots in the sleeve member; and wherein the stop slot is configured to inhibit movement of the housing along the vertical axis in the first direction when the position release is in the deactivated state.

6. A workstation or shelf system comprising the height adjustment apparatus of claim 1.

7. A height adjustment apparatus for a workstation, work table, shelf system, rack system and the like, of the type comprising a work platform or shelf supported by one or more vertical support members each extending along a longitudinal axis and having an upper end portion, the height adjustment apparatus comprising:

a sleeve member extending along the longitudinal axis and attached to the upper end portion of one of the one or more vertical support members, the sleeve member comprising a wall including a plurality of generally horizontally-oriented and vertically-spaced slots, each of the plurality of slots being defined by an upper surface and a lower surface, wherein the upper surface and the lower surface are spaced apart by a first distance;

a housing coupled to the work platform or shelf and disposed over at least a portion of the sleeve member, wherein the housing is moveable along the sleeve member;

a position release having a deactivated state and an activated state and comprising a pawl pivotally coupled to the housing at a pivot location and a biasing member biasing the pawl in a first pivot direction about the pivot location, the pawl comprising a user actuation interface on a first side of the pivot location and a locking tab on a second side of the pivot location, the locking tab comprising an upper side and a lower side, wherein the upper side and the lower side are spaced apart by a second distance that is less than the first distance;

wherein, when the user actuation interface is disengaged the position release is in the deactivated state and the locking tab of the pawl is operable to engage any of the plurality of slots in the sleeve member;

wherein, when the user actuation interface is engaged to overcome the bias of the biasing member and to pivot the pawl in a second pivot direction the position release is in the activated state and the locking tab of the pawl is inoperable to engage any of the plurality of slots in the sleeve member;

wherein, when the position release is in the deactivated state, the housing is movable along the longitudinal axis only in a first direction; and wherein, when the position release is in the activated state, the housing is movable along the longitudinal axis in both the first direction and in a second direction opposite the first direction.

8. The height adjustment apparatus of claim 7, further comprising an end cap adapter coupled to the housing at an upper end of the housing;

wherein the end cap adapter is coupled to the work platform or shelf; and wherein the end cap adapter and the work platform or shelf are moveable with the housing.

9. The height adjustment apparatus of claim 7, wherein each of the plurality of slots in the sleeve member are defined by an upper side comprising an arcuate surface and a lower side comprising a planar surface; and wherein the upper side of the locking tab comprises an arcuate surface and the lower side comprises a planar surface.

10. The height adjustment apparatus of claim 7, further comprising an insert attached to the upper end portion of the one vertical support member;

wherein the sleeve member is disposed over the insert such that at least a portion of the insert is located intermediate the sleeve member and the one vertical support member; and wherein the sleeve member is attached to the insert.

11. The height adjustment apparatus of claim 7, wherein the housing comprises the position release; and wherein the pawl is pivotal relative to the housing.

12. The height adjustment apparatus of claim 7, wherein the housing comprises an opening in a wall of the housing;

wherein the sleeve member further comprises indicia associated with the plurality of slots in the sleeve member, wherein the indicia is representative of a predetermined height adjustment for the work platform or shelf; and wherein the indicia is visible through the opening in the wall of the housing.

13. The height adjustment apparatus of claim 12, wherein the indicia comprises text or graphics associated with each of the plurality of slots in the sleeve member;

wherein the text or graphics is representative of a predetermined height position of the work platform or shelf.

14. The height adjustment apparatus of claim 7, wherein the sleeve member comprises a stop slot defined by an upper side comprising a planar surface and a lower side comprising a planar surface;

wherein the stop slot is located vertically above an uppermost slot of the plurality of slots in the sleeve member; and wherein the stop slot is configured to inhibit movement of the housing along the longitudinal axis in the first direction when the position release is in the deactivated state.

15. A workstation or shelf system comprising the height adjustment apparatus of claim 7.

16. A food preparation workstation comprising:

a first work platform comprising a first rail defining first boundary of the workstation and including a first support surface and a second support surface, the first support surface positioned horizontally along a length of the first rail, the second support surface positioned parallel to and vertically spaced apart from the first support surface;

a second work platform comprising a second rail spaced a distance from the first rail and defining a second boundary of the workstation and including a third support surface and a fourth support surface, the third support surface positioned horizontally along a length of the second rail, the fourth support surface positioned parallel to and vertically spaced apart from the third support surface;

four vertically-oriented support members supporting the first rail and the second rail in a relationship opposed to one another such that the first support surface and the third support surface are aligned in a first plane and the second support surface and the fourth support surface are aligned in a second plane, wherein a work surface is supported on the first support surface and the third support surface and a storage receptacle is supported on the second support surface and the fourth support surface wherein the work surface is operable to translate along the first support surface and the third support surface; and a height adjustment apparatus associated with each of the vertically-oriented support members, each height adjustment apparatus comprising:

a sleeve member extending along and attached to an upper end portion of a corresponding one of the four vertically-oriented support members, the sleeve member comprising a wall including a plurality of generally horizontally-oriented and vertically-spaced slots, each of the plurality of slots being defined by an upper surface and a lower surface, wherein the upper surface and the lower surface are spaced apart by a first distance;

a housing disposed over at least a portion of the sleeve member, wherein the housing is moveable along the sleeve member and wherein a corresponding one of the first work platform and the second work platform is coupled to the housing and is moveable therewith; and a position release having a deactivated state and an activated state and comprising a pawl pivotally coupled to the housing at a pivot location and a biasing member biasing the pawl in a first pivot direction about the pivot location, the pawl comprising a user actuation interface on a first side of the pivot location and a locking tab on a second side of the pivot location, the locking tab comprising an upper side and a lower side, wherein the upper side and the lower side are spaced apart by a second distance that is less than the first distance;

wherein, when the user actuation interface is disengaged the position release is in the deactivated state and the locking tab of the pawl is operable to engage any of the plurality of slots in the sleeve member;

wherein, when the user actuation interface is engaged to overcome the bias of the biasing member and to pivot the pawl in a second pivot direction the position release is in the activated state and the locking tab of the pawl is inoperable to engage any of the plurality of slots in the sleeve member;

wherein, when the position release is in the deactivated state, the housing is movable vertically in a first direction; and wherein, when the position release is in the activated state, the housing is movable vertically in both the first direction and in a second direction opposite the first direction.

17. The food preparation workstation of claim 16, each height adjustment apparatus further comprises an end cap adapter coupled to the housing at an upper end of the housing;

wherein the end cap adapter is coupled to a corresponding one of the first work platform and the second work platform; and wherein the end cap adapter and a corresponding one of the first work platform and the second work platform are moveable with the housing.

18. The food preparation workstation of claim 16, wherein each of the plurality of slots in the sleeve member are defined by an upper side comprising an arcuate surface and a lower side comprising a planar surface; and wherein the upper side of the locking tab comprises an arcuate surface and the lower side comprises a planar surface.

19. The food preparation workstation of claim 16, wherein each height adjustment apparatus further comprises an insert attached to the upper end portion of the one vertical support member;

wherein the sleeve member is disposed over the insert such that at least a portion of the insert is located intermediate the sleeve member and the one vertical support member; and wherein the sleeve member is attached to the insert.

20. The food preparation workstation of claim 16, wherein the housing comprises the position release; and wherein the pawl is pivotal relative to the housing.

21. The food preparation workstation of claim 16, wherein the housing comprises an opening in a wall of the housing;

wherein the sleeve member further comprises indicia associated with the plurality of slots in the sleeve member, wherein the indicia is representative of a predetermined height adjustment for the work platform or shelf; and wherein the indicia is visible through the opening in the wall of the housing.

22. The food preparation workstation of claim 21, wherein the indicia comprises text or graphics associated with each of the plurality of slots in the sleeve member;

wherein the text or graphics is representative of a predetermined height position of the work platform or shelf.

23. The food preparation workstation of claim 16, wherein the sleeve member comprises a stop slot defined by an upper side comprising a planar surface and a lower side comprising a planar surface;

wherein the stop slot is located vertically above an uppermost slot of the plurality of slots in the sleeve member; and wherein the stop slot is configured to inhibit movement of the housing vertically in the first direction when the position release is in the deactivated state.

* * * * *